United States Patent [19]

Matsuura

[11] Patent Number: 4,757,909

[45] Date of Patent: Jul. 19, 1988

[54] BOX-FORMING CORNER MEMBER AND BOX USING THE SAME

[75] Inventor: Hiroomi Matsuura, Kawasaki, Japan

[73] Assignee: Sekisui Kaseihin Kogyo Kabushiki Kaisha, Nara, Japan

[21] Appl. No.: 830,807

[22] Filed: Feb. 19, 1986

[30] Foreign Application Priority Data

Feb. 21, 1985 [JP] Japan ..... 60-33285
Jun. 7, 1985 [JP] Japan ..... 60-86605[U]

[51] Int. Cl.[4] ..... B65D 7/24

[52] U.S. Cl. ..... 220/7; 220/77; 229/49; 217/69; 403/217

[58] Field of Search ..... 220/77, 7, 6; 229/49; 217/69; 403/403, 231, 217, 176, 172

[56] References Cited

U.S. PATENT DOCUMENTS

| | | | |
|---|---|---|---|
| 886,462 | 5/1908 | Amos | 229/49 |
| 2,168,911 | 8/1939 | Meyer | 217/69 |
| 2,229,395 | 1/1941 | Stock | 229/49 |
| 2,284,458 | 5/1942 | Van Antwerp | 217/69 X |
| 2,547,112 | 4/1951 | Daniels | 217/69 |
| 2,549,509 | 4/1951 | Munroe | 217/69 X |
| 3,220,633 | 11/1965 | Swane | 229/49 |
| 3,315,639 | 4/1967 | Close | 403/176 X |
| 3,497,127 | 2/1970 | Box | 220/6 X |

*Primary Examiner*—Steven M. Pollard
*Attorney, Agent, or Firm*—Armstrong, Nikaido, Marmelstein & Kubovcik

[57] ABSTRACT

A corner member for forming a foldable box has a bottom section to be attached to a corner of a bottom panel of the box and two lateral sections to be attached to portions of adjacent lateral panels of the box. The lateral sections are attached to the bottom section individually through hinge sections and are capable of being joined together by a locking mechanism when vertically raised with respect to the bottom section. An assembled box using the above corner member includes a bottom panel, lateral panels framed around the bottom panel, and the above corner member disposed at each corner portion of the box. The corner portions of the bottom panel are attached to the bottom sections of the above corner members, while two adjacent lateral panels are respectively attached to two vertically standing lateral sections of the corner member which are respectively attached to the above bottom section through hinge sections and the lateral panels are thereby framed with one another. The two lateral sections of each corner member are joined together by the above locking mechanism and the lateral panels can thus be unfolded by disconnecting the locking mechanism.

19 Claims, 10 Drawing Sheets

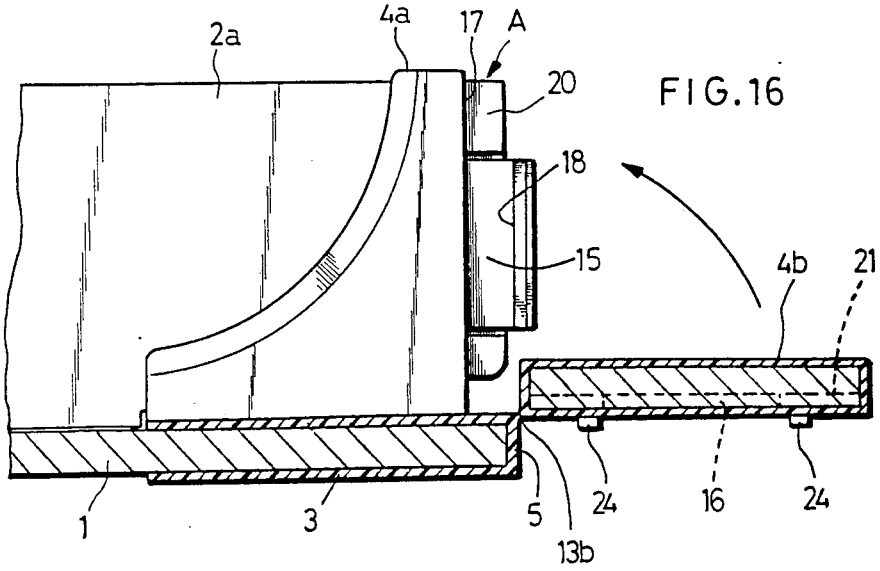
FIG.16
FIG.17
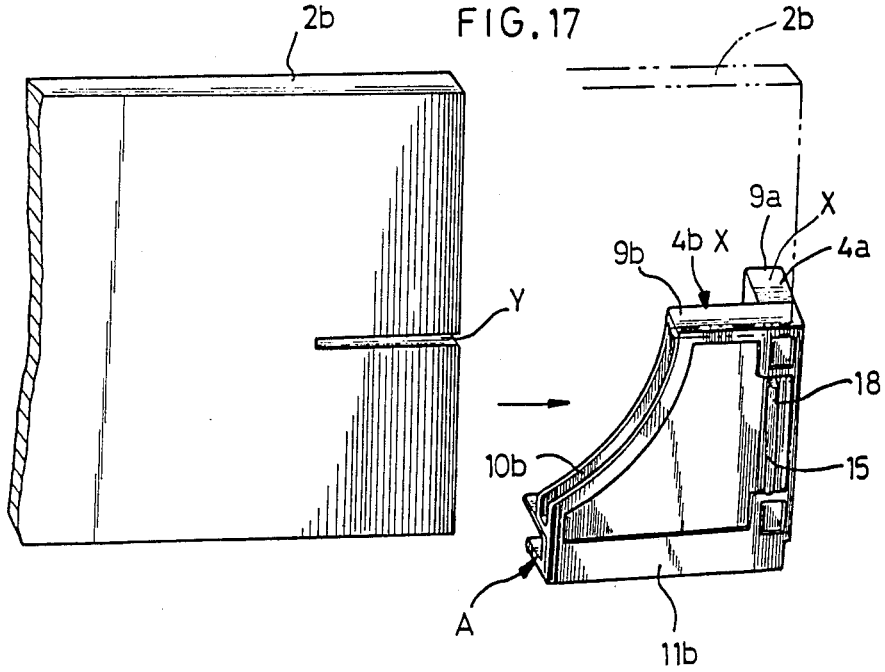

BOX-FORMING CORNER MEMBER AND BOX USING THE SAME

BACKGROUND OF THE INVENTION

The present invention relates to a corner member used for forming a foldable box and to a box assembled by using the above corner member.

A box made of wood or synthetic resin assembled in a factory by nailing, screwing or bonding a bottom and a lateral panel together or lateral panels together takes much time and labor in manufacture and is bulky and hence is inconvenient to transport to a place where it will be used or to handle it when it is not in use; thus, it has been proposed to assemble or unfold such a box on location for use.

Examples of such proposed boxes include a box made of synthetic resin having lateral panels which may be raised around a bottom panel through hinge portions (see, for example, Japanese Utility Model Application Laid-Open No. 16295/1980) and another box has been suggested which is designed so that the bottom and lateral panels are separately formed and thereafter joined together (see, for example, Japanese Patent Publication No. 7091/1964). However, as means for joining lateral panels together in an assembly operation, most of them employ such means as nailing, screwing or bonding, thus requiring much time and labor in the assembly and disassembly operations for assembling the box into a developed shape and for breaking down into a transportable configuration. Further, there is a box adapted to be assembled by fitting means using L-shaped connectors (see Japanese Utility Model Publication No. 28676/1977 and U.S. Pat. No. 3,613,931), but since the above connectors are used to join only two faces such as a bottom and lateral panel together or lateral panels together, a large number of such connectors are required and the fitting operation is troublesome. There is still another box which is assembled using hinge-like corner connectors (see, for example, Japanese Utility Model Publication No. 27274/1969), but, in an assembly operation thereof, it is difficult to attach the connectors to lateral panels and the like; thus, a disadvantage arises in that the assembly operation still requires much time and labor. Furthermore, a box may be assembled by engaging means using pins and slots formed on the butt ends of adjacent lateral panels (see, for example, U.S. Pat. Nos. 3,874,546 and 3,446,415), but this box also has disadvantages in that lateral panels are complicated in construction and difficult to produce. Another box which is assembled by fitting means using projections and slots formed on butt ends of adjacent lateral panels (see, for example, U.S. Pat. No. 3,675,808) has a drawback that the strength of the fitting is not sufficient. Further, a box in which ends of butted lateral panels are clamped by corner members and thereby joined together (see, for example, U.S. Pat. No. 3,544,021) is inconvenient in that; since it is necessary to increase the thickness of lateral panels, they can hardly be formed of thin corrugated boards or synthetic resin foam boards.

SUMMARY OF THE INVENTION

Accordingly, it is an object of the present invention to provide a box-forming corner member which makes it possible to readily assemble separately formed bottom and lateral panels wherein the panels are capable of being composed of various material such as thin corrugated boards, synthetic resin foam boards, and the like.

It is another object of the invention to provide a foldable box assembled by using the above-mentioned corner members.

A box-forming corner member according to a first embodiment of the present invention comprises a bottom section to be attached to a corner of a bottom panel of the box and two lateral sections to be attached to end portions of lateral panels of the box. The box-forming corner member of the invention is characterized in that the lateral sections are attached to the bottom section through hinge sections and formed such that they are capable of being joined together by a locking means when vertically raised into position with respect to the bottom section.

A box using the above corner member according to a second embodiment of the invention comprises a bottom panel, lateral panels framed around the bottom panel, and corner members disposed at each corner portions of the box. The box of the second embodiment is characterized in that each corner portion of the bottom panel is attached to the bottom section of the corner member, two adjacent lateral panels are respectively attached to two vertically standing lateral sections of the corner member which are attached to the bottom section of the corner member through hinge sections, thereby all lateral panels are framed with one another, and the two vertically standing lateral sections of the corner member are joined together through a locking means, and the lateral panels can be unfolded by disconnecting the locking means.

BRIEF DESCRIPTION OF THE DRAWINGS

FIGS. 15 and 16 are sectional views showing boxes according to other embodiments of the invention; and FIG. 17 is a partly exploded perspective view of a box wherein a height of lateral plates is changed.

BRIEF DESCRIPTION OF THE PREFERRED EMBODIMENTS

Figure 9:
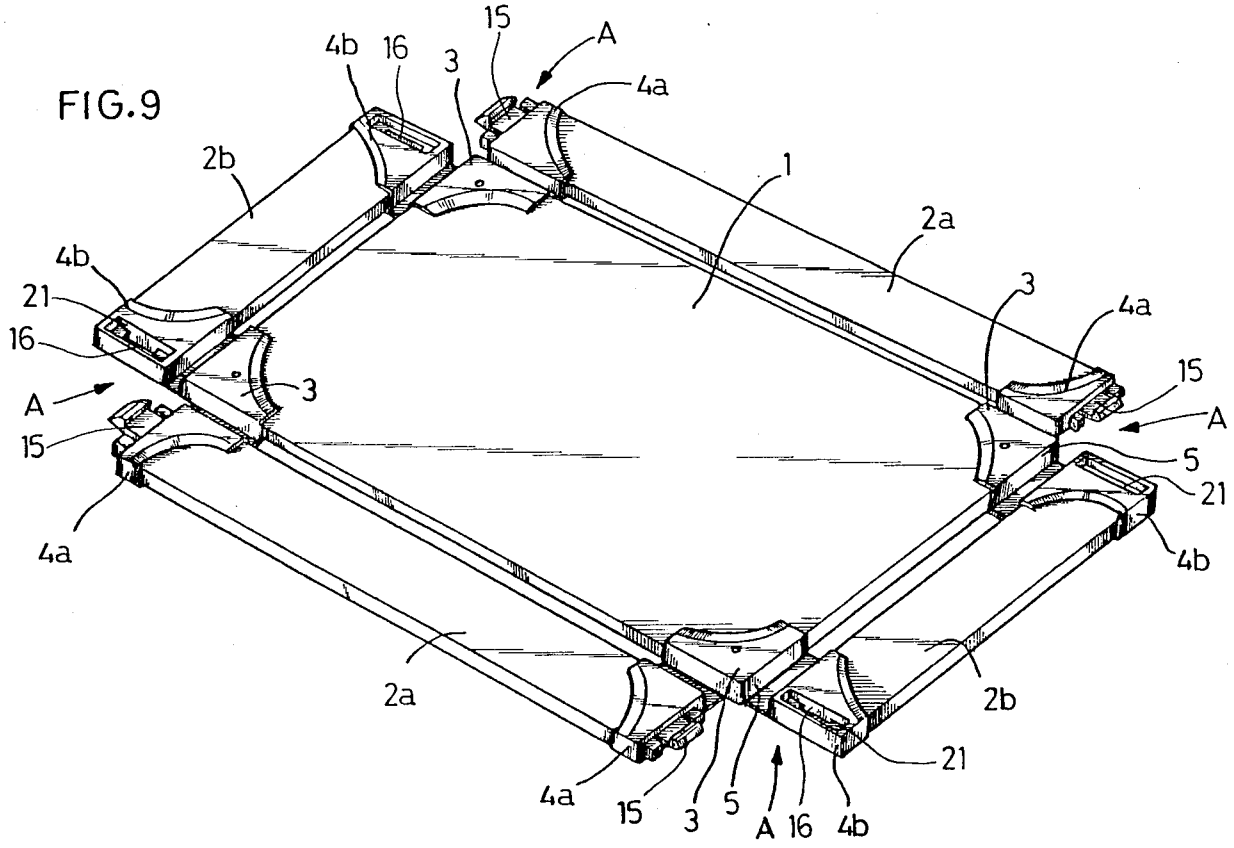
FIG. 9 is a perspective view showing a box using corner members before it is assembled.

In the drawings, A denotes a box-forming corner member according to the present invention, 1 denotes a box forming bottom panel, and 2*a* and 2*b* (see particularly FIG. 9) denote box-forming lateral panels respectively disposed at opposed positions along the lateral edges of the bottom panel 1.

The aforesaid corner member A is integrally formed of synthetic resin, having a bottom section 3 to be attached to the bottom panel 1 and two lateral sections 4*a* and 4*b* to be attached to the lateral panels 2*a* and 2*b* in a box-forming operation. As for the synthetic resin which forms the corner member A, it is preferable to employ polypropylene resin when dimensional accuracy and the fatigue strength of hinge sections 13*a* and 13*b* to be later described are taken into account, but it is also possible to employ other synthetic resins such as polyethylene resin and polyvinyl chloride resin.

The bottom section 3 has end panel portion 5 substantially L-shaped to correspond to the corner portions of the bottom panels 1, and upper and lower panel sections 6 and 7 opposed to each other with a spacing therebetween which is substantially equal to the thickness of the bottom panel 1.

The portion surrounded with the end panel section 5 and upper and lower panel sections 6 and 7 is formed as a slot S1 for receiving the corner portions of the bottom panel 1, so that the bottom section 3 and bottom panel 1 can be joined together by simply inserting the corner portions of the bottom panel 1 into the slot S1 in a box-forming operation. In addition, the upper and lower panel sections 6 and 7 are formed with holes 8 for receiving fixing means such as screws or rivets, according to the need.

Further, the lateral sections 4*a* and 4*b* are formed with slots S2 and S3 for receiving the end portions of the lateral panels 2*a* and 2*b*, the slots being defined by substantially L-shaped end panel portions 9*a* and 9*b* and upper and lower panel portions 10*a*, 11*a* and 10*b*, 11*b* opposed to each other with a spacing therebetween which is substantially equal to the thickness of the lateral panels 2*a* and 2*b*. Thus, the lateral panels 2*a* and 2*b* can be attached parallel to the sides 5*a* and 5*b* of the end panel portion 5 of the bottom section 3 by simply inserting them into the slots S2 and S3 in a box-forming operation. Further, the lateral sections 4*a* and 4*b* are respectively connected to the sides 5*a* and 5*b* of the end panel portion 5 along the lower panel portions 11*a* and 11*b* through connecting panels 12*a* and 12*b*, with a spacing defined therebetween which corresponds to the width of the end panel portion 5. The regions of the connecting panels 12*a* and 12*b* adjacent to the bottom section 3 are formed with hinge portions 13*a* and 13*b* in the form of V-shaped grooves, U-shaped grooves or the like, so that the lateral sections 4*a* and 4*b* can be raised from the lateral edges of the bottom section 3 by bending them along the hinge sections 13*a* and 13*b* so as to cause the connecting panels 12*a* and 12*b* to extend along the end panel portion 5 of the bottom section 3. By raising the lateral sections 4*a* and 4*b* from the lateral edges of the bottom section 3 in this manner, the load produced by stacking boxes formed using the corner member A can be firmly supported by the bottom section 3.

Figure 2:
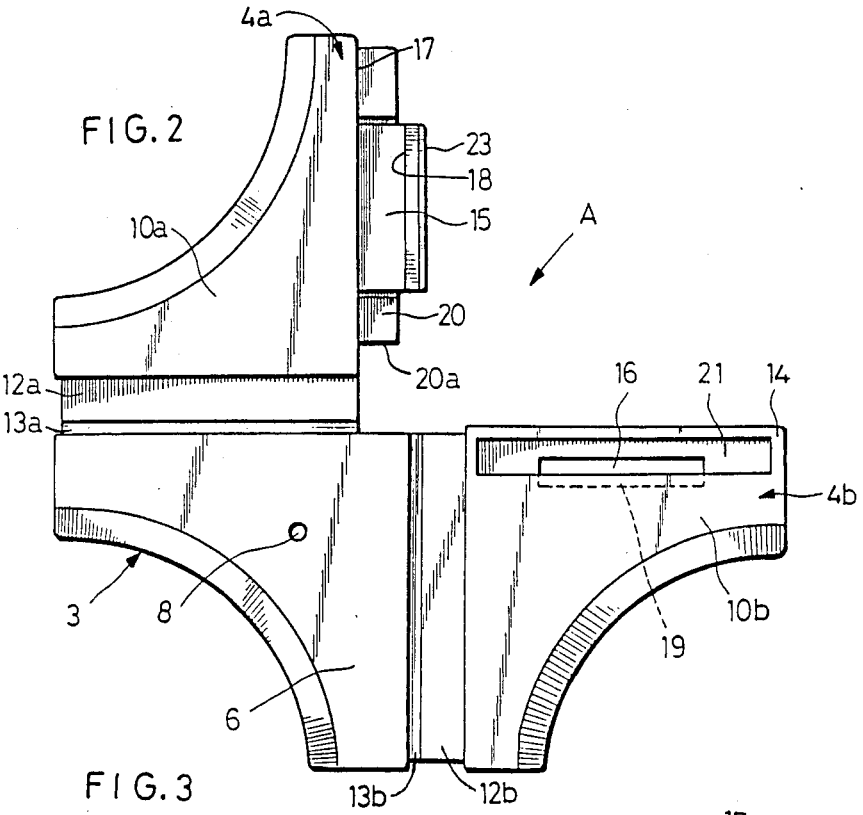
FIG. 2 is a plan view of the same.
Figure 6:
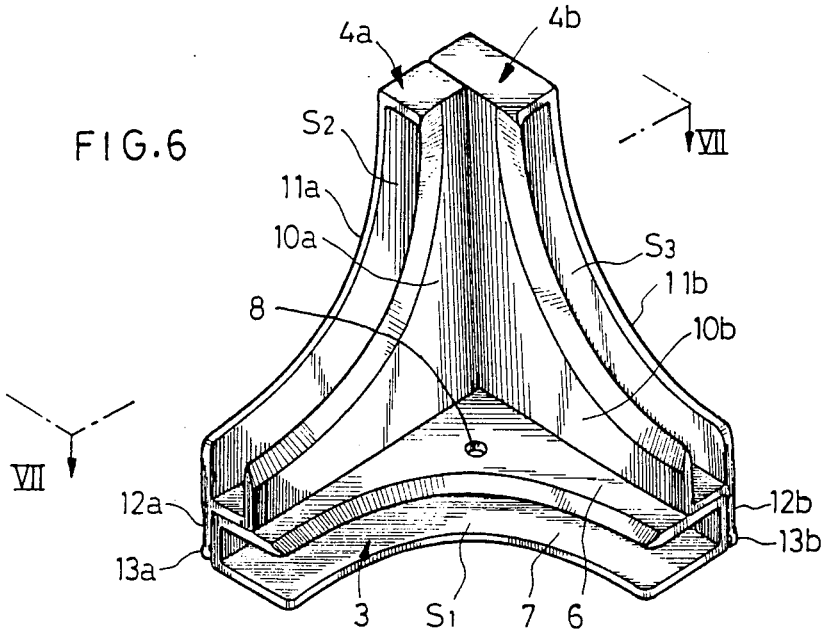
FIG. 6 is a perspective view showing the joined state of the lateral sections.

Further, one lateral section 4*a* has removed therefrom a portion on the corner side corresponding to the thickness of the lateral section 4*b* so that the lateral section 4*a* can be butted against the inner side of the end portion 14 of the other lateral section 4*b* when it is raised (see particularly FIGS. 2 and 6). And the butt end portions of the lateral sections 4*a* and 4*b* are formed with locking means so that the lateral sections 4*a* and 4*b* can be joined together when they are raised upright.

The locking means is constituted of an elastically deformable plate-like engaging element 15 projecting from the butt end surface 17 of one lateral section 4*a*, and an opening 16 formed in the butt end portion 14 of the other lateral section 4*b*. The front end portion 18 projecting therefrom substantially at right angles thereto, said engaging element 15 being fitted in the opening 16, said locking portion 18 being locked to the notched step portion 19 of the opening 16 (see FIGS. 3 and 7), whereby the lateral sections 4*a* and 4*b* and hence the lateral panels 2*a* and 2*b* can be butt-joined together.

Figure 3:
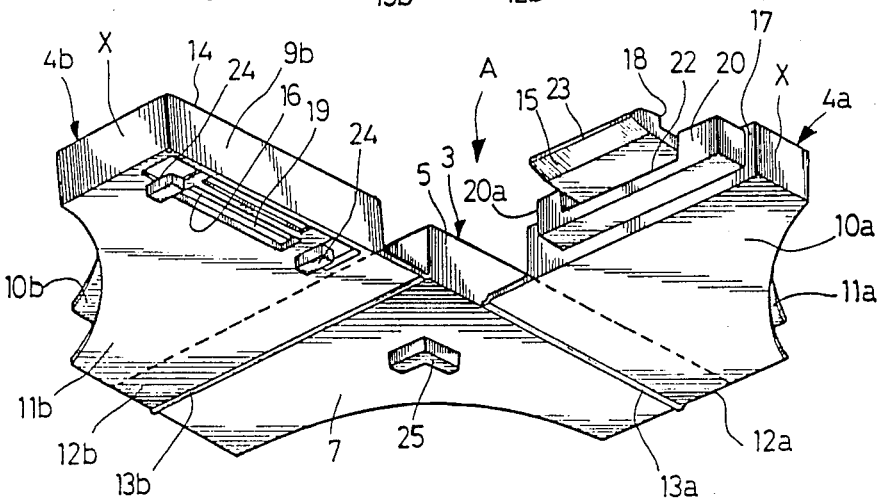
FIG. 3 is a perspective view of the same taken from below.

Although the engaging construction of only the engaging element 15 and the opening 16 is sufficient to maintain the lateral sections 4*a* and 4*b* in the joined state, particularly in the case of this embodiment, the butt end surface 17 of one lateral section 4*a* is formed with a projecting portion 20 while the butt end portion 14 of the other lateral section 4*b* is formed with a recessed portion 21 in which the projecting portion 20 can fit in their butted state, so that the fitting engagement between the projecting and recessed portions 20 and 21 makes possible the positioning of the lateral sections 4*a* and 4*b* in their butted state. Further, the engaging element 15 and the projecting portion 20, as shown in FIG. 3, are made independent of each other on the back side of the locking portion 18 by providing a predetermined clearance 22 and the front end of the locking portion 18 is formed with an inclined surface 23 so that when the projecting and recessed portions 20 and 21 are to be fitted together, the inclined surface 23 is slid along the edge of the opening 16 to gradually elastically deform the engaging element 15 for fitting in the opening 16. The engaging element 15 could be formed on the front end surface of the projecting portion 20, in which case, however, the engaging element 15 could not obtain a sufficient projection height above the front end surface of the projecting portion 20 and hence it would have little elasticity. Thus, as illustrated, it is preferable to separately form the projecting portion 20 and the engaging element 15 so as to impart some elasticity to the engaging element 15. In addition, contrary to the illustrated case, it is, of course, possible to form the recessed portion 21 on the lateral section 4*a* having the engaging element 15 while forming the projecting portion 20 on the lateral section 4*b* having opening 16.

Figure 7:
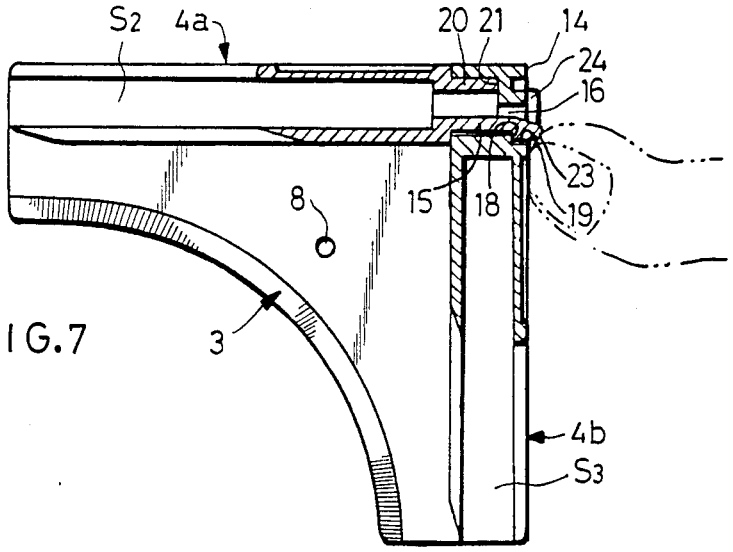
FIG. 7 is a sectional view taken along the line VII—VII in FIG. 6.

The projection height of the engaging element 15 above the butt end surface 17 is such that when in the state of engagement with opening 16, the front end projects slightly beyond the outer surface of the lateral section 4*b*; thus, by pressing the front end of the engaging element 15 against the elastic force in the predetermined direction, it is possible to separate the locking portion 18 from the notched step portion 19 in order to cancel the engagement between the engaging element 15 and opening 16 (see FIG. 7). In addition, instead of the front end of the engaging element projecting beyond the outer surface of the lateral section 4*a*, the outer periphery of opening 16 may be somewhat removed to allow the engaging element 15 to project beyond opening 16; in this case also, the same separating operation as described above can be attained.

Figure 4:
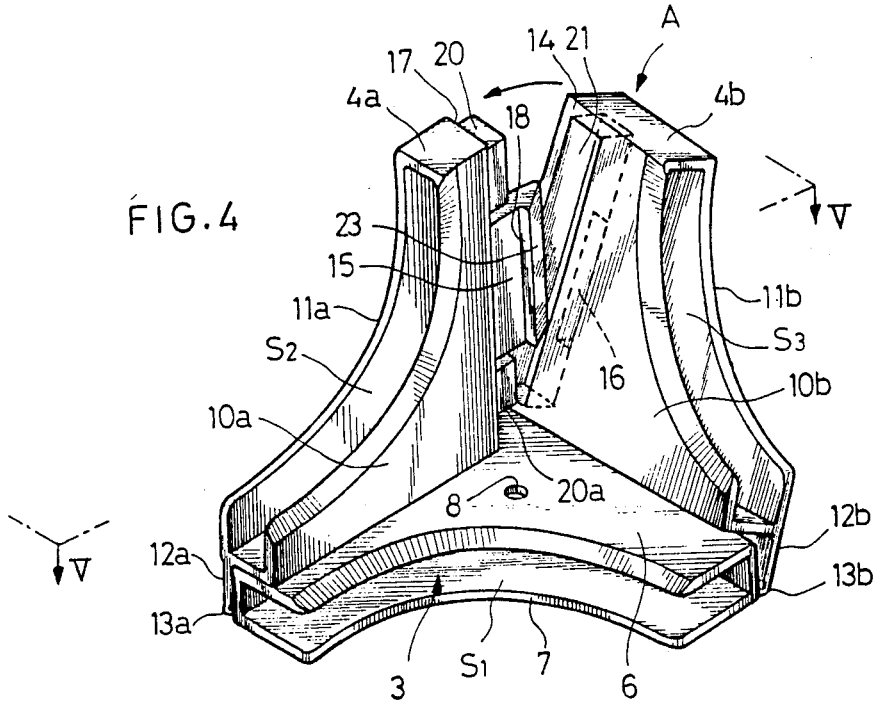
FIG. 4 is a perspective view showing how lateral sections are joined together.
Figure 5:
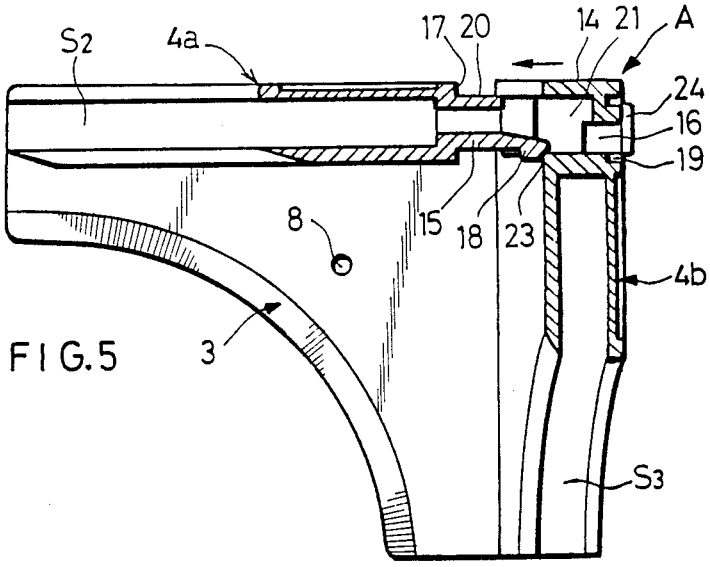
FIG. 5 is a section view taken along the line V—V in FIG. 4.

In order to fit the projecting and recessed portions 20 and 21 together, it is preferable, as described above, that the projecting portion 20 be somewhat shorter than the recessed portion 21 on the lower side 20*a* and that the front end of the lower side of the recessed portion 21 be rounded so that the lower end of the projecting portion 20 may not collide with the lower end portion of the recessed portion 21 in the initial fitting stage shown in FIG. 4. This arrangement ensures a smooth fitting action between the projecting and recessed portions 20 and 21 attending the bending and raising action on the lateral section 4*b* around the hinge section 13*b*.

Figure 8:
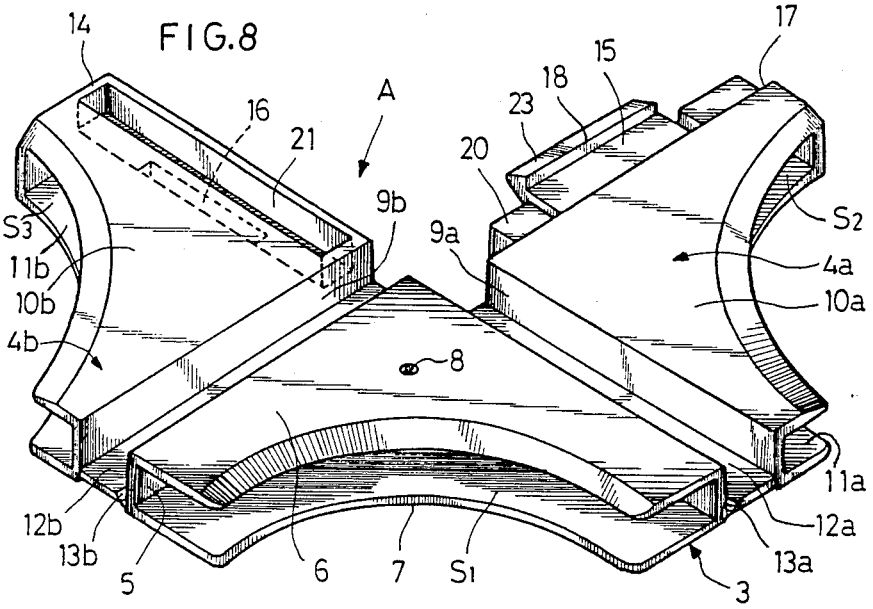
FIG. 8 is a perspective view showing a corner member according to another embodiment of the invention.

In addition, in the corner member A of the aforesaid construction, the left-hand side lateral section as viewed from the opened side of the bottom section 3 has been constructed as the lateral section 4*a* having the engaging element 15 on the end surface, but a corner member A shown in FIG. 8 is reversely constructed so that the right-hand side lateral section as viewed from the opened side of the bottom section is the lateral section 4*a* having the engaging element 15 on the end surface thereof.

Figure 1:
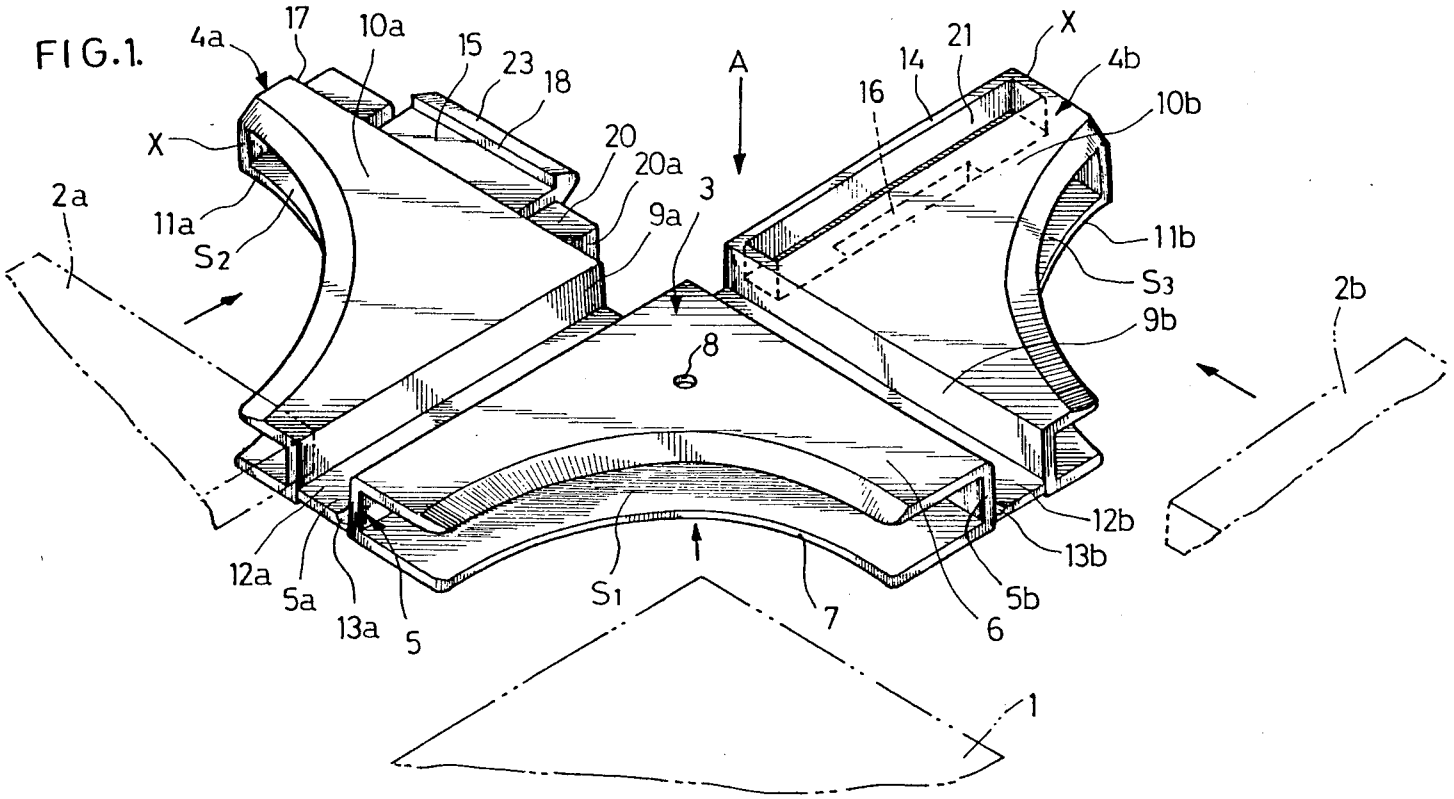
FIG. 1 is a perspective view showing a corner member according to an embodiment of the invention.

Usually, two types of corner members A of the invention as shown in FIGS. 1 and 8 are used by being disposed at the diagonally opposite corner portions of a box. That is, the bottom sections 3 of the two types of corner members A are attached to the corresponding corner portion of the bottom panel 1 so that the lateral section 4*a* having the engaging element 15 and the lateral section 4*b* having the opening 16 may be symmetrically disposed, and the lateral sections 4*a* and 4*b* are attached to the ends of the lateral panels 2*a* and 2*b* (see FIG. 9). And when not in use, the lateral panels 2*a* and 2*b* are unfolded by disconnecting the engaging element 15 of each corner member A, so that the box using the corner members may be shipped in the flat or unfolded state.

Figure 11:
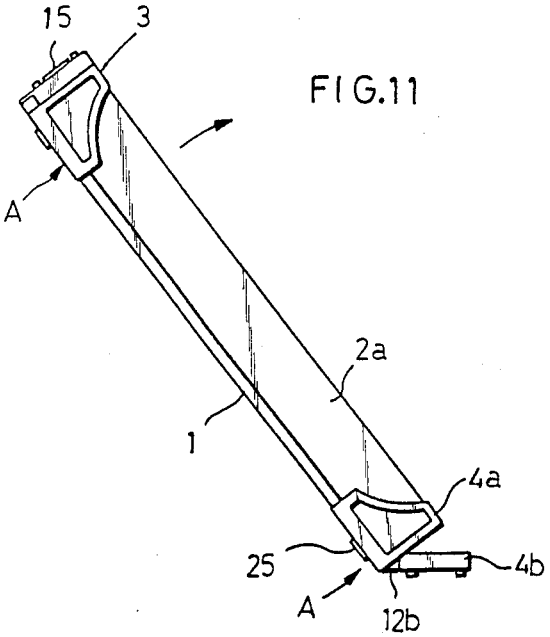
FIG. 11 is a side view of the same.
Figure 10:
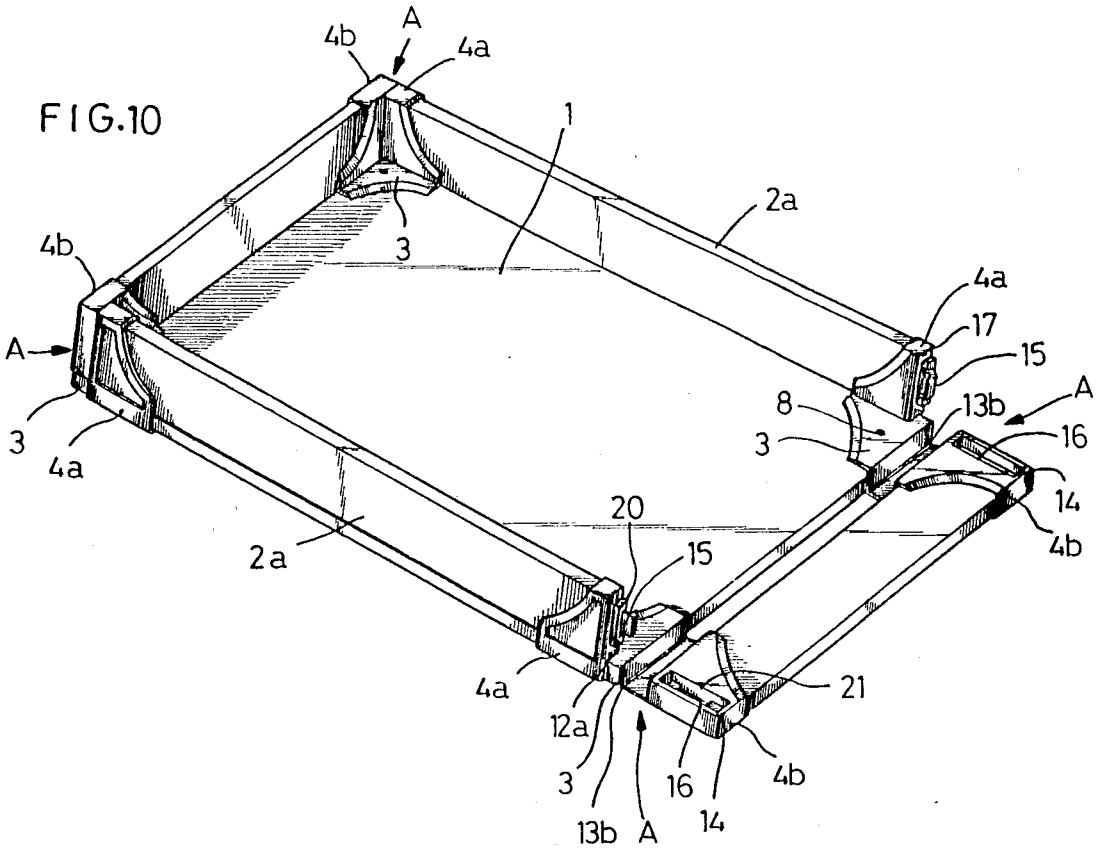
FIG. 10 is a perspective view showing an intermediate state of assembly of a box.
Figure 12:
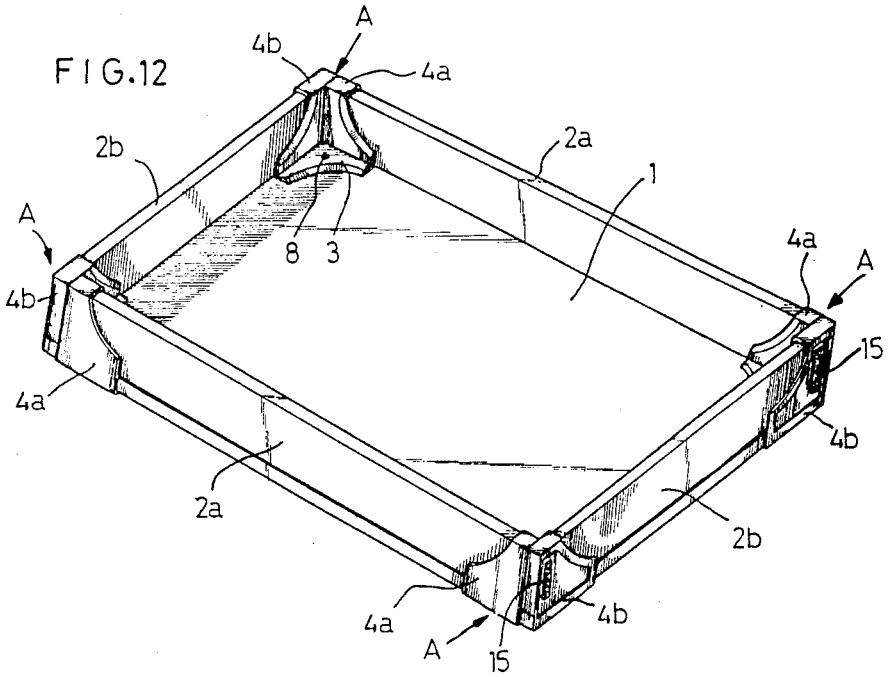
FIG. 12 is a perspective view showing the completed state of assembly of the box.

To assemble a box from the unfolded state, first, the opposed lateral panels 2*a* are joined to the lateral sections 4*a* at the sides having the engaging elements 15 are bent together with the lateral sections 4*a* along with the hinge sections 13*a* and are raised into position with the end panel portions 9*a* of the lateral sections 4*a* mounted on the lateral edges of the bottom sections 3 (see FIG. 10). Subsequently, one of the opposed lateral panels 2*b* joined to the sides of the lateral sections 4*b* having the openings 16 is bent and raised into position together with the lateral section 4*b* along the hinge section 13*b*, and at the same time, the engaging elements 15 of the lateral sections 4*a* are fitted in the openings 16 in the lateral sections 4*a* to engage the engaging elements 15 with the openings 16, thereby joining the raised lateral sections 4*a* and 4*b* in their butted state. The other lateral panels 2*b* are similarly raised together with the lateral sections 4*b* in the same manner as before so as to engage the engaging elements 15 with the openings 16, thereby joining the lateral sections 4*a* in their butted state. Particularly in this case, as shown in FIG. 11, if the box is raised, the engaging elements 15 and the openings 16 of the corner members A at adjacent places can be engaged with each other at the same time. This means that a box wherein a bottom panel 1 and lateral panels 2*a* and 2*b* are joined together can easily be assembled.

The box assembled in the manner described above can be easily unfolded by pressing the front end of the engaging element 15 projecting beyond the opening 16 by a finger in a predetermined direction, as shown in FIG. 7, to disengage the locking portion 18 from the opening 16 and then outwardly tilting the lateral panels 2*a* and 2*b*.

In addition, as shown in FIG. 3, if projections 24 are formed at predetermined positions on the outer surface of the lateral section 4*b* having the opening 16 formed thereon, then, the front end of the engaging element 15 of the lateral section 4*a* can be easily projected outward beyond the lateral section 4*b* where a box is to be assembled by raising the box as shown in FIG. 11; therefore, the simultaneous engagement between the engaging elements 15 and the openings 16 of two adjacent corner members A can be further facilitated.

In the corner members A described above, the projecting and recessed portions 20 and 21 in the butt portions of the lateral sections 4*a* and 4*b* may be omitted. However, as illustrated, the use of the fitting between the projecting and recessed portions 20 and 21 is preferable from the standpoint of the retention of the strength of the joined state. Further, the engaging element 15 and opening 16 which serve as the locking means are not limited to the illustrated ones; for example, the locking portion 18 may be projecting toward the outside of the box or such locking portions may be formed at a plurality of locations corresponding to each other. Thus, various constructions capable of engagement are possible.

Figure 13:
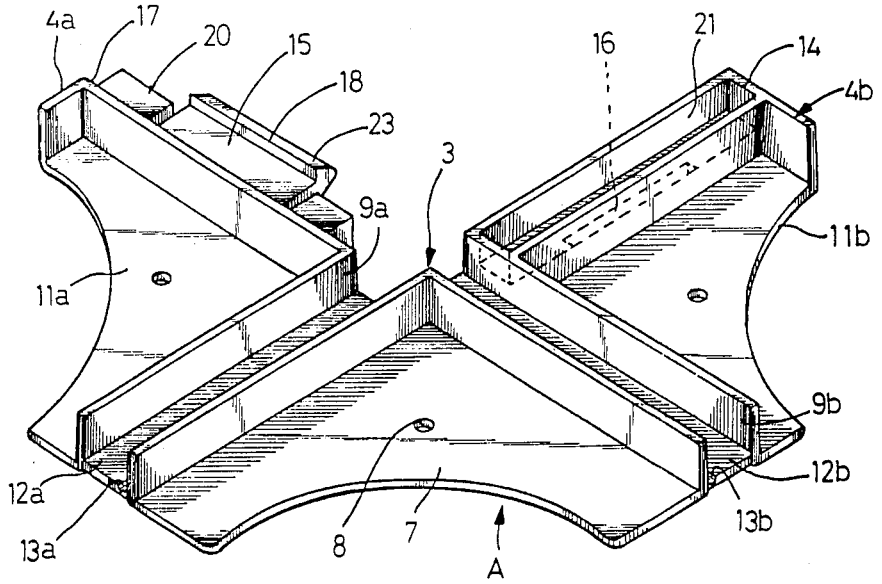
FIG. 13 is a perspective view showing a corner member according to another embodiment of the invention.

Further, in the embodiments described above, the bottom section 3 of the corner members A has been shown having its opened edge curved, but the shape of the opened edge may be variously changed; for example, it may be sectoral, substantially triangular or quadrangular. Particularly where such attaching means as screwing, riveting or bonding is used, the upper panel portion 6 may be reduced in width to have only the lateral edge portion or may be omitted (see FIG. 13). As for the lateral sections 4*a* and 4*b*, it is possible, as is done in the bottom section 3, to variously change the shape of the opened edge. However, as shown in FIG. 1, where the upper sides X of the end panel portions 9*a* and 9*b* are shorter than the lower sides, there is an advantage that the operation of joining the lateral sections 4*a*, 4*b* and lateral panels 2*a*, 2*b* can be effected more easily. Further, as in the case of the bottom section 3, where such attaching means as screwing, riveting or bonding is utilized, various attaching constructions may be employed, such as omission of either the upper panel portions 10*a*, 11*a* or the lower panel portions 10*b*, 11*b* (see FIG. 13). Further, it is preferable to chamfer the opened edge of the upper panel portion 6 of the bottom section 3 and the opened edges of the upper and lower panel portions 10*a*, 11*a* and 10*b*, 11*b* of the lateral sections 4*a* and 4*b*, as shown. In addition, in FIG. 3, the numeral 25 denotes a positioning projection for fitting in a lower box when boxes are stacked.

Figure 14:
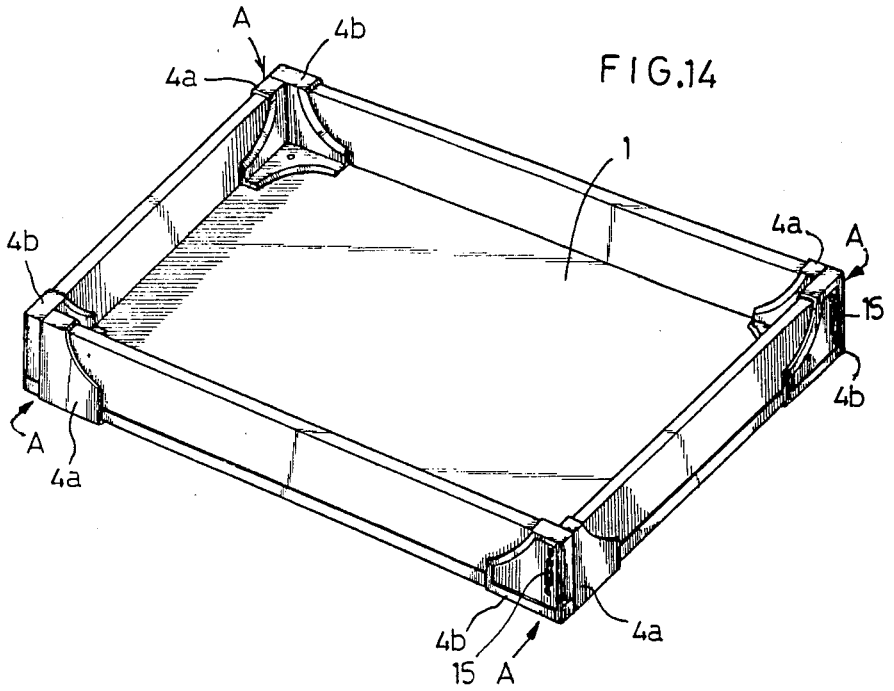
FIG. 14 is a perspective view showing a box according to another embodiment of the invention.

Further, it is possible to form a box by using only either the corner member A shown in FIG. 1 or the corner member A shown in FIG. 8 (see FIG. 14). In this case, the lateral sections 4*a* and 4*b* successively raised from one corner portion to another are joined together by engagement between the engaging element 15 of one and the opening 16 of another. As for the last corner member A, the engaging element 15 may be fitted in the opening 16 by utilizing the elasticity of the materials of the lateral sections 4*a*, 4*b* and lateral panels 2*a*, 2*b*.

In addition, in the case of the embodiments described above, since a load of stacking can be supported by the corner members A, it is possible to use boards of various of not only thin wood or synthetic resin but synthetic resin foams, corrugated boards, or the like for the bottom panel 1 and lateral panels 2*a* and 2*b*.

Figure 15:
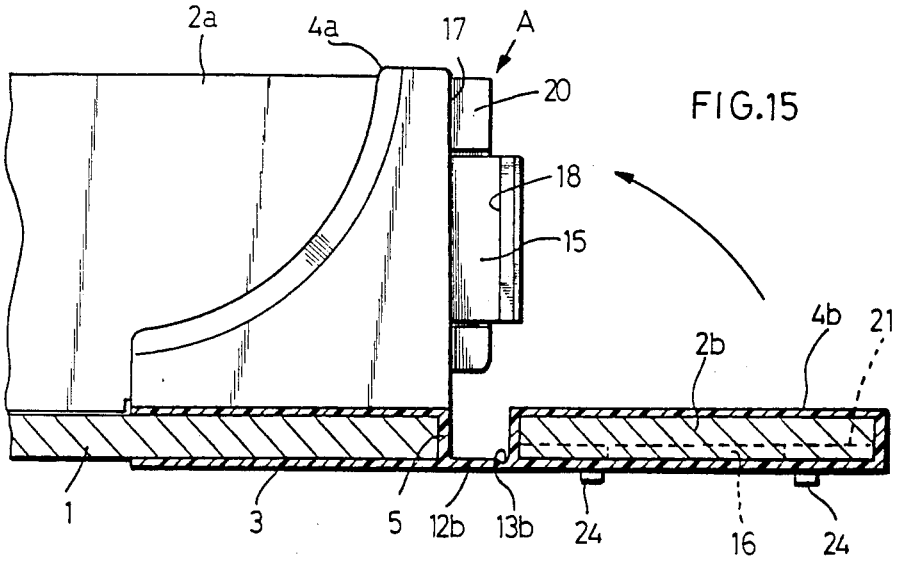

The hinge sections 13*a* and 13*b* for connection between the lateral sections 4*a*, 4*b* and the bottom section 3 maybe formed adjacent to the lateral sections 4*a* and 4b, as shown in FIG. 15, in which case, the lateral sections 4a and 4b can be raised on the connecting panels 12a and 12b while extending the lateral sections 4a and 4b along the end panel portion 5 of the bottom section 3. Furthermore, as shown in FIG. 16, connection may be made by using the hinge sections 13a and 13b alone while omitting the connecting panels 12a and 12b, in which case the lateral sections 4a and 4b can be raised on the lateral edge of the bottom section 3.

Further, besides the case where the entire end portion is fitted to the lateral sections 4a and 4b as in the embodiments described above, it is possible, as shown in FIG. 17, to form, at predetermined places on the end portions of the lateral panels 2a and 2b, slits Y adapted to receive the upper sides x of the end panel portions 9a and 9b of the lateral panels 2a and 2b so as to engage only the lower portions of the lateral panels 2a and 2b with the lateral sections 4a and 4b, in which case it is possible to form a box which is deeper than the height of the corner members A.

As has so far been described, according to the box forming corner members of the invention, the bottom panel and the lateral panels therearound can be joined together by simply attaching the bottom section and lateral sections to the corner portions of the bottom panel and the end portions of the lateral panels. Further, by raising the lateral sections, the three panels, i.e., the bottom panel and two adjacent lateral panels can be joined together in their assembled state at a corner portion where they cross each other by using one corner member. And after the corner members of the invention have been attached to the bottom panel and lateral panels, the box can be assembled or unfolded in one operation; thus, the box assembling and unfolding operations can be simplified and accelerated.

Further, if the corner members of the invention are used in a box, since the materials for the bottom panel and lateral panels thereof can be freely selected from among various materials including synthetic resin boards, glass, wire netting, wood, synthetic resin foams and corrugated boards, the best box meeting the customer's requirements such as shock resistance, heat insulation, water resistance, or chemical resistance can be formed.

On the other hand, a box according to the invention assembled using the above-mentioned corner members can be brought into a flat less bulky shape with the lateral panels unfolded with respect to the bottom panel when it is not in use as when it is transported; therefore, transport and storage efficiencies can be greatly increased and transport cost required for sending back empty boxes can be reduced to a great extent.

Further, the box of the invention is superior in stability of assembled lateral panels and hence the shape-retention of the box is superior. Particularly, in the assembled state, the corner portions of the box exhibit a unique columnar structure due to the lateral sections of the corner members, firmly supporting the load of stacking; therefore, even when a board of relatively low strength, such as a thin corrugated board or synthetic resin foam board, is used, a sufficient stacking strength can be attained.

What is claimed is:

1. A box forming corner member for a box having individual panels including a bottom panel and a plurality of lateral side panels, said corner member comprising:

a bottom section attachable to a corner of the bottom panel of the box, said bottom section having two generally perpendicular edges corresponding to the corner of the bottom panel;

first and second lateral sections, each attachable to an end portion of one of adjacent lateral side panels of the box, each lateral section having a bottom edge and a side edge generally perpendicular to one another;

first and second hinge means for pivotally connecting said bottom edge of each lateral section to one of the edges of said bottom section, such that said lateral sections form a corner with said bottom section when fully pivoted in a closed state, and such that said lateral sections can be repeatedly pivoted with respect to said bottom section; and a locking means for repeatedly, detachably locking said two lateral sections together in the closed state, such that said two lateral sections extend generally perpendicular to said bottom section.

2. The box-forming corner member of claim 1, wherein said locking means comprises:

an engaging element projecting from one of said lateral sections; and an opening formed on the other of said lateral sections for cooperative engagement with said engaging element.

3. The box-forming corner member of claim 2, wherein said engaging element has a locking portion projecting therefrom, substantially at a right angle.

4. The box-forming corner member of claim 2, wherein said engaging element projects beyond said opening when said engaging element and said opening are engaged with one another in the closed position.

5. The box-forming corner member of claim 4, wherein an outer surface side of said lateral section having said opening has a projection formed at a predetermined position, said projection having substantially the equal height to the projecting height of said engaging element beyond said opening.

6. The box-forming corner member of claim 1, wherein said locking means includes a projecting portion on one of said lateral sections and a recessed portion on the other of said lateral sections, said projecting and recessed portions being cooperatively engageable in the locked state.

7. The box-forming corner member of claim 1, wherein said corner member is integrally formed of a synthetic resin.

8. A foldable box, comprising:

a bottom panel;

individual lateral panels framed around said bottom panel and separate therefrom;

a corner member disposed at each corner of said bottom panel each corner member including, (a) a bottom section attached to each of the corners of said bottom panel, (b) two lateral sections, each attached to the end of one of adjacent lateral panels, (c) first and second hinge means for pivotally connecting the bottom section to said lateral sections, individually, to form a corner, such that said lateral sections can be repeatedly pivoted with respect to said bottom section, and (d) a locking means for repeatedly, detachably locking said two lateral sections together, such that said lateral sections extend generally perpendicular with respect to said bottom section in the locked state, and such that when each of said corner members is in the locked state, a box is formed.

9. The box forming corner member of claim 1, wherein said bottom section includes a lower panel section generally parallel to said bottom panel and having said perpendicular edges, and wherein said bottom section also includes a generally L-shaped end panel extending generally perpendicularly from the edges of said lower panel section.

10. The box-forming corner member of claim 9, wherein said first and second lateral sections, each include a lower panel portion having said bottom and side edges, and an L-shaped end panel portion extending from said edges and being generally perpendicular to said lower panel portion.

11. The box-forming corner member of claim 10, wherein said L-shaped end panel portions extend from their respective lower panel portions a distance substantially equal to the thickness of their respective panels.

12. The box-forming corner member of claim 11, wherein said bottom section also includes an upper panel section generally parallel to said lower panel section and attached to said L-shaped end panel portion in order to form a slot between said upper and lower panel portions for receiving the corner of said bottom panel therebetween.

13. The box-forming corner member of claim 12, wherein said first and second lateral sections each include an upper panel portion disposed generally parallel to the respective lower panel portion of each lateral section, and being attached to a corresponding one of said L-shaped end panel portions to form a slot between said upper and lower panel portions for receiving one of said lateral panels therebetween.

14. The box-forming corner member of claim 11, wherein each of said hinge means includes a connecting panel extending from the bottom edge of each lateral section to a corresponding edge of said bottom section, with a longitudinal hinge adjacent said bottom section.

15. The box-forming corner member of claim 14, wherein each of said connecting panels has a width substantially equal to the thickness of said bottom section to enable one side of each of said L-shaped end panel portions of said lateral sections to bear against an upper part of said bottom section when in the fully pivoted closed state.

16. The box-forming corner member of claim 14, wherein said longitudinal hinge comprises a longitudinal groove in said connecting panel.

17. The box-forming corner member of claim 11, wherein the side edge of one of said first and second lateral sections is spaced from the corner of said bottom section a distance substantially equal to the width of the other of said lateral sections in order to enable the proper fit of the lateral section with one another when in the closed state.

18. The box of claim 8, wherein said first and second hinge means include resilient hinges.

19. The box forming corner member of claim 1, wherein said first and second hinge means include resilient hinges.

* * * * *